US006951282B2

(12) United States Patent
Jones

(10) Patent No.: US 6,951,282 B2
(45) Date of Patent: Oct. 4, 2005

(54) PEEL AWAY TAB CHILD RESISTANT PACKAGE

(75) Inventor: Marty Jones, Mebane, NC (US)

(73) Assignee: Meadwestvaco Corporation, Stamford, CT (US)

( * ) Notice: Subject to any disclaimer, the term of this patent is extended or adjusted under 35 U.S.C. 154(b) by 141 days.

(21) Appl. No.: 10/292,939

(22) Filed: Nov. 13, 2002

(65) Prior Publication Data

US 2003/0213721 A1 Nov. 20, 2003

Related U.S. Application Data

(60) Provisional application No. 60/380,557, filed on May 14, 2002.

(51) Int. Cl.[7] ..... B65D 85/42; B65D 73/00

(52) U.S. Cl. ..... 206/469; 206/531; 206/538

(58) Field of Search ..... 206/528, 531, 206/532, 534, 538, 539, 469; 53/453, 471

(56) References Cited

U.S. PATENT DOCUMENTS 4,125,190 A * 11/1978 Davie et al. ..... 206/532
4,537,312 A * 8/1985 Intini ..... 206/531
5,339,960 A * 8/1994 Price ..... 206/531
5,758,774 A * 6/1998 Leblong ..... 206/531
5,927,500 A 7/1999 Godfrey
5,944,191 A 8/1999 Ray
5,954,202 A * 9/1999 Mellon ..... 206/462
6,024,222 A * 2/2000 Friberg et al. ..... 206/531
6,161,699 A 12/2000 Gartland
6,273,260 B1 * 8/2001 ColDepietro et al. ..... 206/532
6,669,236 B1 * 12/2003 Hollwarth-Oberholz ..... 283/81
6,675,972 B2 * 1/2004 Patterson ..... 206/531
6,708,825 B2 * 3/2004 Filion et al. ..... 206/531
2003/0168376 A1 * 9/2003 Taneja et al. ..... 206/534

* cited by examiner

*Primary Examiner*—Mickey Yu
*Assistant Examiner*—Faye Francis

(57) ABSTRACT

A packaging substrate is formed that has at least the following elements. A main panel with at least one gate formed on the main panel to assist with removing contents from a package cell. At least one cell flap secured to the main panel. The cell flap has at least one aperture dimensioned and aligned to fit over a package cell. At least one tab flap secured to the main panel on an opposite end from the cell flap. The tab flap further comprises at least one peel away tab and at least one glue tab. The peel away tab is aligned and dimensioned so that when properly folded it will substantially overlap the gate or gates of the main panel.

4 Claims, 2 Drawing Sheets

PEEL AWAY TAB CHILD RESISTANT PACKAGE

CROSS-RELATED APPLICATION

This application is related to and claims benefit of U.S. provisional patent application No. 60/380,557 filed on May 14, 2002.

FIELD OF THE INVENTION

This invention generally relates to a child resistant blister package having a package design that substantially prevents a child from opening the package.

BACKROUND OF THE INVENTION

It is well known to use blister packaging to contain items such as pharmaceutical tablets or capsules. Conventional blister packages include a blister tray. The tray is typically a thermo-formed plastic sheet having a plurality of blister cells or depressions formed on the sheet. Typically after the items are placed in the cells, they are retained and protected in the cell by securing a foil or paperboard lid over the blister cells. In another type of conventional package the items are placed in substantially puncture proof foil containers that are then covered with a foil or paperboard lid.

Typically with foil lids, the foil is thin enough to be either punctured mechanically or ruptured by pressing the contents against the foil. Typically with paperboard lids, gates are formed in the lid in the general vicinity of the blister cells to assist with removing the contents from the cells. Each gate is deformed or manipulated so that it ruptures or partially separates from the lid allowing the content of the blister cell to be pushed through the gate.

While the conventional blister packages are suitable for some applications there are several deficiencies in their design. Although they provide easy removal of the contents from the blister cell, they offer very little protection from children opening the blisters. Child resistance is a feature that is particularly desired for unit dose pharmaceutical packaging, and is mandated by the Poison Prevention Packaging Act of 1970. Guidelines are prescribed for packaging to satisfy the criteria for child resistance under the statute. For example, a child resistance (CR) rating of F=1 requires that a random sampling of the subject packages not be compromised by an age specific test pool of children at a failure rate of greater than 10%. This general guideline is designed to ensure that the package has sufficient integrity against tampering by children. In view of this requirement, it is an object of the invention to provide a packaging system with improved child resistance.

In addition to child resistance, however, it is also desirable that the packaging system be senior friendly to permit easy withdrawal of the package contents with minimum manipulation. Such a withdrawal means should be easy to use even if the patient's manual dexterity or strength is reduced. Accordingly, another object of the present invention is to provide a senior friendly package that can be easily manipulated by the user. Based on at least the above deficiencies in the prior art, what is needed is a package that is substantially child resistant yet senior friendly and a method of making the package.

SUMMARY OF THE INVENTION

The present invention provides an improvement over the previously developed blister packaging in that there has now been developed a package system having structural elements that make the package substantially child resistant yet senior friendly. A packaging substrate is formed that has at least the following elements. A main panel with at least one gate formed on the main panel to assist with removing contents from a package cell. At least one cell flap secured to the main panel. The cell flap has at least one aperture dimensioned and aligned to fit over a packaged cell. At least one tab flap secured to the main panel on an opposite end from the cell flap. The tab flap further comprises at least one peel away tab and at least one glue area. The peel away tab is aligned and dimensioned so that when properly folded it will substantially overlap the gate or gates of the main panel.

In an exemplary embodiment, a packaging system is formed by securing at least one sealed packaged cell to the main panel. The cell flap is then folded over the packaged cell flap and secured to the main panel. The tab flap is folded and secured to an opposite side of the main panel from the packaged cell. The product is removed from the system, by peeling away the tab flap over a gate, and rupturing the gate on the main panel and manipulating the packaged cell content through the gate.

The above and other features of the present invention will become more apparent in the description below and can be understood by reading the following detailed description in conjunction with the accompanying figures, wherein like characters represent like parts throughout the several views.

DETAILED DESCRIPTION OF THE INVENTION

Figure 1:
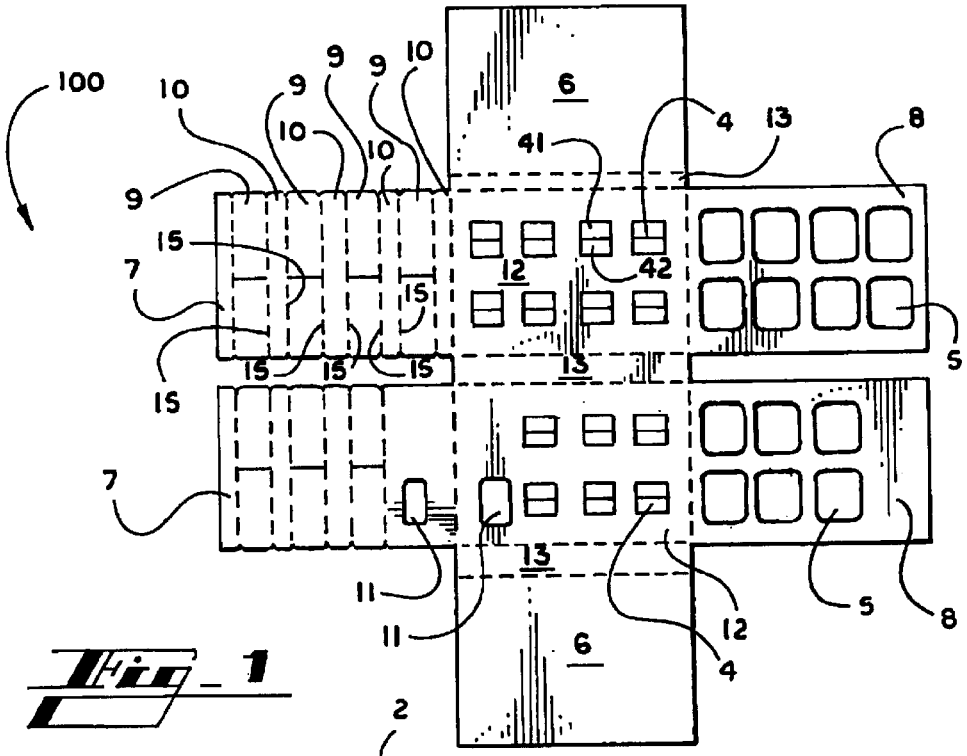
FIG. 1 is a plan view of a packaging substrate according to the invention.

FIG. 1 illustrates a plan view of a packaging substrate 100 according to the invention. The package substrate 100 is illustrated with two main panels 12 and several flaps 6, 7, 8 secured to the main panels 12. In an exemplary embodiment, the main panels 12 are illustrated secured to each other by a hinge panel 13. Likewise flaps 6 are illustrated secured to the main panels 12 by hinge panels 13. The remaining flaps 7, 8 are illustrated as being formed from the main panels 12. Flaps 7, 8 can be exemplary formed by cutting and creasing or folding the flaps 7, 8 from the substrate used to form main panels 12. It is to be understood that the layout, dimensions, number, and method of forming the main panels 12 and flaps 6, 7, 8 as illustrated in FIG. 1 is exemplary.

Several gates 4 are illustrated along the main panels 12. The gates 4 are illustrated in a closed position with the two parts of the gate 41, 42 secured to each other. When the two parts 41, 42 of a gate 4 are opened or separated a product in a package cell 3 (FIG. 2) can pass through the gate 4. In addition, an exemplary aperture 11 is illustrated on one main panel 12 and is aligned with an aperture 11 on an adjoining flap 7. The apertures 11 provide a visual path for any information secured to a package tray (discussed below) to be viewed. Two flaps 8 are illustrated with a plurality of apertures 5. The apertures 5 are dimensioned and aligned to fit snug around the package cells 3 of a package tray 200 (discussed below). Two flaps 7 are illustrated with a plurality of glue tabs 10 and peel away tabs 9. The glue tabs 10 and peel away tabs 9 are secured to each other along lines 15. In an exemplary embodiment, the glue tabs 10 and peel away tabs 9 are formed from the same substrate. The respective tabs 9, 10 are formed with a partial die cut or perforation 15 separation using techniques well known in the art. The scope of the invention is not limited to the numbers and arrangements of the main panels and flaps in this illustration but rather encompasses a configuration of one or more main panels 12 and one or more of the various flaps 6, 7, 8 secured to each other by suitable means according to purpose of the package.

The package substrate 100 material may be selected from any suitable substrate material to include conventional paperboard grades, for example solid bleached sulfate (SBS) paperboard ranging in weight upward from about 10 point, preferably from about 11 points to about 14 points. An exemplary substrate 100 includes a 12-point SBS board manufactured by MeadWestvaco Corporation. The substrate 100 may also be an unbleached board, depending on the desired appearance of the final package. The substrate if paperboard is preferably coated on at least one side, with a conventional coating selected for compatibility with the printing method and board composition. The package substrate 100 would typically be formed so that after folding the coated side would become the external surface of the package. This allows for information about the package contents to be viewed without opening the package.

Figure 2:
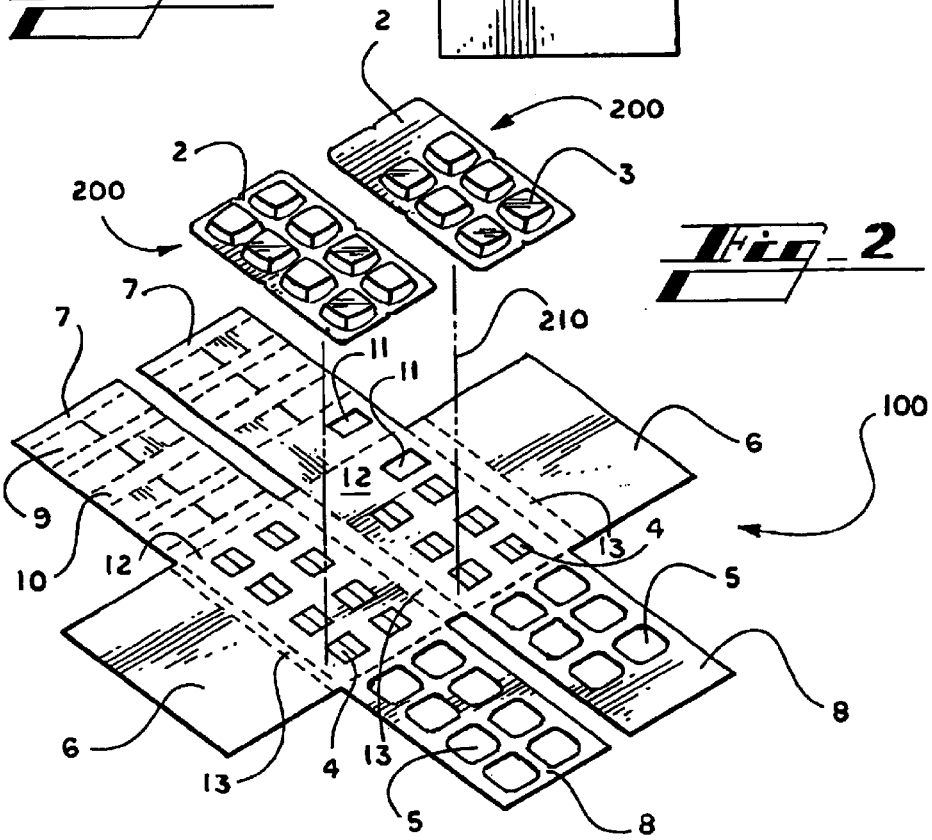
FIG. 2 is an isometric view of the packaging substrate of FIG. 1 with a sealed package tray aligned over the gates of the packaging substrate according to the invention.

FIG. 2 illustrates an isometric view of two sealed package trays 200 prior to securing them to the package substrate 100 as illustrated by direction 210. The package trays 2 are exemplary illustrated with a flat tray area 2 and a series of package cells 3. On the hidden view, a lid or barrier layer is secured to the side opposite the package cells 3 to seal in the contents of the cells 3. As discussed below, the sealed package trays 200 are secured to the main panels 12 and aligned so that the cells 3 are situated over the perforated gates 4. The package trays 200 are then secured to the substrate 100.

Figure 3:
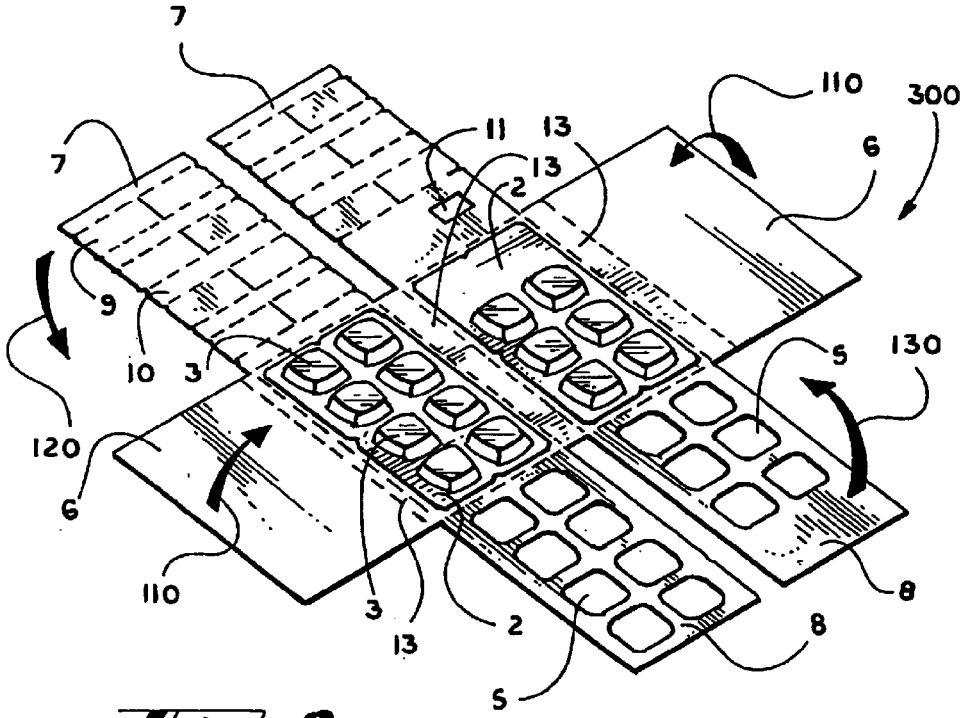
FIG. 3 is an isometric view of a sealed package tray secured to the packaging substrate.

FIG. 3 illustrates an exemplary package 300 after the sealed package trays 200 are secured to the main panels 12. Direction arrows 110, 120, and 130 illustrate an exemplary method of folding flaps 6, 7, and 8 after the package trays 200 are in place. Flaps 8 are folded over the package trays 200 in the direction marked by the arrow 130. As previously discussed, the apertures 5 are dimensioned and aligned to fit around the package cells 3. In an exemplary embodiment, flaps 8 are secured to package trays 200. Flaps 6 are folded over flaps 8 in the direction marked by arrow 110. In an exemplary embodiment, flaps 6 are secured to flaps 8. Flaps 7 are folded on the side opposite the package trays 200 in the direction marked by arrow 120. In an exemplary embodiment, the flaps 7 are secured to the main panels 12 with adhesive along the glue tabs 10. It is to be understood that flaps 7 must be secured to the main panels 12 in such a manner as to allow the peel away tabs 9 to be removed to access the gates 4 of the main panel 12.

Figure 4:
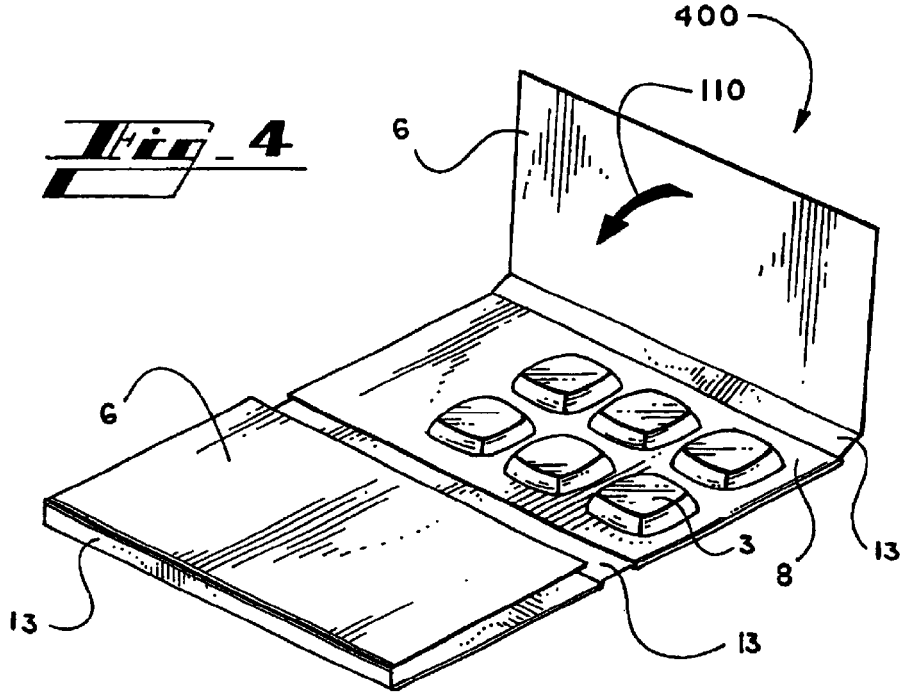
FIG. 4 is an isometric view of a partially formed package folded according to the exemplary folding pattern illustrated in FIG. 3.

FIG. 4 illustrates a partially formed package 400 according to the folding directions 110, 120, 130 discussed above in FIG. 3. It is to be understood that the package 400 can be further folded and the flaps 6 can be secured to each other.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A packaging blank comprising:

at least one main panel wherein said main panel further comprises at least one gate;

at least one cell flap secured to said main panel, wherein said cell flap further comprises at least one aperture dimensioned to fit over a package cell secured to said main panel;

at least one tab flap secured to said main panel opposite said cell flap, wherein said tab flap further comprises at least one peel away tab and one glue tab wherein said peel away tab is aligned and dimensioned and secured to substantially overlap said gate of said main panel on an opposite side from said cell flap.

2. The packaging blank of claim 1, wherein a protective flap is secured to the main panel on a side adjacent to said cell flap and said tab flap, wherein said protective flap is dimensioned to cover said aperture of said cell flap.

3. The packaging blank of claim 1, wherein said gate comprises two areas secured to each other.

4. A method of forming a substantially child resistant package comprising the steps of:

forming a package blank from a package substrate wherein said blank comprises:

at least one main panel wherein said main panel further comprises at least one gate;

at least one cell flap secured to said main panel, wherein said cell flap further comprises at least one aperture dimensioned to fit over a package cell secured to said main panel;

at least one tab flap secured to said main panel opposite said cell flap, wherein said tab flap further comprises at least one peel away tab and one glue tab wherein said peel away tab is aligned and dimensioned and secured to substantially overlap said gate of said main panel on an opposite side from said cell flap;

aligning at least one sealed package tray over said main panel and said gate and securing to said main panel; wherein said sealed package further comprises at least one package cell;

folding said cell flap over said sealed package tray and securing to said package tray;

folding said tab flap over said main panel on an opposite side of said package tray and securing at least some portion of said tab flap to said main panel.

* * * * *